US006202912B1

(12) United States Patent
Perret et al.

(10) Patent No.: US 6,202,912 B1
(45) Date of Patent: Mar. 20, 2001

(54) ACCUMULATION UNIT FOR A BAND PRODUCT

(75) Inventors: Jean Perret, Montbrison; François Leroux, Senlis, both of (FR)

(73) Assignee: Kvaerner Metals Clecim, Courbevoie (FR)

( * ) Notice: Subject to any disclaimer, the term of this patent is extended or adjusted under 35 U.S.C. 154(b) by 0 days.

(21) Appl. No.: 09/305,661

(22) Filed: May 5, 1999

(30) Foreign Application Priority Data

May 5, 1998 (FR) ..... 98 05679

(51) Int. Cl.[7] ..... B65H 20/30

(52) U.S. Cl. ..... 226/118.2; 226/118.4; 226/189; 226/190

(58) Field of Search ..... 226/118.2, 190, 226/189, 118.1; 242/419.7

(56) References Cited

U.S. PATENT DOCUMENTS

| | | | | |
|---|---|---|---|---|
| 3,687,348 | | 8/1972 | Scheib | 226/113 |
| 4,391,400 | * | 7/1983 | Sylvain | 226/118.2 X |
| 4,886,199 | * | 12/1989 | Noe et al. | 226/118.2 |
| 5,769,302 | * | 6/1998 | Richert et al. | 226/118.1 |
| 5,999,248 | * | 12/1999 | Wary et al. | 226/118.2 X |

FOREIGN PATENT DOCUMENTS

| | | |
|---|---|---|
| 2150759 | 10/1973 | (DE) . |
| 3610214 | 10/1987 | (DE) . |
| 2023549 | 1/1980 | (GB) . |
| 63-130217 | 6/1988 | (JP) . |

OTHER PUBLICATIONS

Patent Abstracts of Japan, vol. 012, No. 378 (M–751), Oct. 11, 1988.

* cited by examiner

*Primary Examiner*—Donald P. Walsh
*Assistant Examiner*—Minh-Chau Pham
(74) *Attorney, Agent, or Firm*—Greenblum & Bernstein P.L.C.

(57) ABSTRACT

A band product accumulation unit including a mechanism for controlling the running of a band along a longitudinal direction, a fixed frame, a wrap-around carriage which is moveable on a track between a return position of minimum accumulation length and an out position of maximum accumulation length, wherein movement towards the out position increases a length while movement towards the return position decreases the length, the band being adapted to pass over at least one return member mounted on the wrap-around carriage so as to form at least an out portion and at least a return portion and defined by at least two spaced levels, a plurality of intermediate supporting members arranged along the track, each comprising at least one separating arm extending horizontally on at least one intermediate level disposed between two running levels of the band, each separating arm being fixed to a shaft which is pivotal about a vertical axis with respect to the fixed frame, a mechanism for controling the pivoting of each separating arm between an open position which allows the wrap-around carriage to move to the return position and a closed position wherein each separating arm extends transverse to and between the two running levels of the band, and a control mechanism for controlling the pivoting of each separating arm between the closed position and the open position.

14 Claims, 4 Drawing Sheets

ACCUMULATION UNIT FOR A BAND PRODUCT

FIELD OF THE INVENTION

This invention relates to a band product accumulation unit comprising a wrap-around carriage, mobile longitudinally, in order to vary the accumulated length.

Such a unit, often called a horizontal accumulator, is described in particular in the document U.S. Pat. No. 3,687,348.

BACKGROUND OF THE INVENTION

Generally speaking, a horizontal accumulator of such type comprises means controlling the running of the band, as a pulley block would, between fixed rollers and mobile rollers mounted on a wrap-around carriage which moves on a horizontal circulation track, along a longitudinal running axis, in order to form several superimposed portions running in opposite directions.

The band running forward, for instance, at lower level, passes on a return idler placed on a wrap-around carriage, comes back at higher level up to a fixed return idler placed at the upstream end of the track, in the running direction of the band, is fed forward again, passes over a return idler again mounted on another wrap-around carriage, is fed backward again onto a third level, and so on, whereas the band can be evacuated forward, while passing above the wrap-around carriage or, as is more often the case, backwards, to be directed toward a processing unit, for instance a pickling unit.

Inside the accumulator, the band forms therefore several superimposed portions running in opposite directions, respectively out and back on several spaced levels. For instance, in the layout according to the document U.S. Pat. No. 3,687,348, the band runs on six levels while passing over three return idlers. The idlers are situated on three different carriages, but it is possible, in other layouts, to use a single wrap-around carriage comprising several return idlers.

The length of accumulated band depends on the position of the wrap-around carriage on the circulation track and on the number of rollers supported by the carriage when a single carriage is used for several portions.

It is necessary to avoid any contact between the various portions of the band which run in opposite directions and this is the reason why the accumulator is connected to a plurality of intermediate supporting members, arranged along the circulation track of the carriage and carrying separating arms which extend horizontally, each on an intermediate level, between two running levels of the band.

However, the carriage should be allowed to come through in order to vary the length of accumulated band and it is why the supporting arms can pivot between a home position, parallel to the running axis, allowing the carriage to come through, and a working position for which the separating arm extends transversally between both running levels of the band.

Moreover, to reduce the moving masses and the cantilever length of the separating arms, the arms can advantageously be divided into two sections located on either side of the track and mounted respectively on two shafts provided along the track and installed to pivot each around a vertical axis. The pivoting of both shafts, respectively bringing the semi-arms home or extending them, is controlled by the displacement of the carriage on the track, in one direction or the other. For instance in the layout according to the document U.S. Pat. No. 3,687,348 or the document DE-A-2150759, each separating semi-arm is connected to a cam follower working together with a cam-operated device mounted on the carriage and whose profile has been determined to control the rotation of the separating arm around its shaft, in one direction or the other, according to the displacement direction of the carriage.

In the layout described in the document DE-A-2150759, each semi-arm supports a cam follower and is therefore substantially aligned with the band when the arms are closed. Consequently, the carriage supports two curved cams, each comprising a central inlet portion for the cam follower, this central portion being substantially aligned with the band and moving gradually away up to an outlet portion offset laterally in a position which matches complete opening of the arm.

Such a device does not enable to anticipate the time when the door opens since the said device solely starts to operate when the central portion of the carriage reaches the level of both separating semi-arms. Still, in modern units, the carriage moves at relatively high speed and, with the layout according to the document DE-A-2150759, there is a risk of violent impact against a door, which is not open yet or is open insufficiently.

For this reason, in the layout according to the document U.S. Pat. No. 3,687,348, both cam followers controlling the pivoting of each semi-arm are mounted respectively on either side of the track, each at the end of a control lever rotating integral together with the arm. Each cam follower working together with a cam provided on the wrap-around carriage side and which can extend cantilever towards the front section of the carriage over a distance enabling to anticipate the pivoting of the arm. However, the lateral frame supporting each cam is rather fragile and the cantilever distance is therefore somewhat minimal. Consequently, the anticipation time is too small for high carriage displacement velocities that may be reached in modern units.

Moreover, the ratio of the length that can be given to the cam in order to control the 90° rotation of each semi-arm to the necessary lateral spacing is rather small and the double curvature of the cam is therefore relatively significant. There might be, at high velocities, risks of impact and, due to wear, increased clearances liable, in the long run, to cause material deterioration and too frequent stops of the production line.

Besides, untimely opening of the separating arms should be avoided in case of contact with the moving band.

Therefore, each separating arm must be connected with a locking device that, in the layout according to the document DE-A-2150759, is composed of a disk fitted with two notches corresponding, respectively, to the closed position and the open position of the arms, and into which may engage a lock that is mounted on a spring-loaded lever and working together itself with a second cam supported by the carriage. Thus, as soon as the cam follower engages into the first cam, the second cam controls the release of the lock which remains out of the way to enable the arm to rotate, whereas the lock engages into the second notch upon completion of the opening movement.

Still, clearances appear in the long run and the arm may unfortunately become unlocked, especially when the band runs at high speed, whereas an excessive load on the separating arm may cause untimely pivoting of the arm, thereby risking to make engaging with each other the portions of the band.

Besides, a synchronisation defect may generate damages and stop the unit in case of collision of the wrap-around carriage with a separating arm.

Moreover, as we have already stated, modern units operate at very high speed, whereby the carriage undergoes significant accelerations and it is therefore necessary to reduce, as far as possible, the inertia of the devices used for controlling the pivoting or the locking of the arms.

The aim of the invention is to obviate these various problems thanks to mechanism for controlling the rotation and the locking of the separating arms enabling the accumulator to operate in safety, whereas the mechanism used are particularly straightforward and of low inertia.

SUMMARY OF THE INVENTION

The invention therefore relates, generally, to a band product accumulation unit comprising mechanism for controlling the running of the band along a longitudinal direction, a wrap-around carriage movable on a track between a first position of minimum accumulation length and a second position of maximum accumulation length, respectively in an out direction to increase the length and in a return direction to decrease the length, whereby the band passes over at least one return member mounted on the carriage in order to form at least two portions, respectively an out and a return portion, over at least two spaced levels, a plurality of intermediate supporting members arranged along the track and each comprising at least one separating arm extending horizontally on at least one intermediate level between two running levels of the band and mounted to pivot around a vertical axis, on a fixed frame, and a mechanism for controlling the pivoting of each separating arm between an open position for the passage of the wrap-around carriage and a closed position for which the separating arm extends transversally between both running levels of the band, the controlling mechanism being actuated, when the wrap-around carriage passes them, by a follower device working together with an active surface of a cam-operated device mounted on the wrap-around carriage.

According to the invention, the follower device is offset with respect to the pivoting axis of the arm, ahead of the latter in the out direction of displacement of the carriage determining the closing of the arm and the follower device is connected to the arm rotation control mechanism by a liable deformation articulated mechanism with two stable extreme positions, respectively a first position corresponding to the open position of the arm and a second position corresponding to the closed position of the arm, whereas the articulated mechanism is connected to removable retaining device of the mechanism with a locking action, at least in the second closing position of the separating arm, whereas the removable retaining device is actuated solely by the follower device working with the cam-operated device when the wrap-around carriage passes, respectively for blocking the mechanism in the out direction of the carriage and for releasing the mechanism in the return direction.

According to a preferred embodiment, each separating arm is fixed in rotation on a shaft mounted to pivot around a vertical axis, whereby the arm rotation control mechanism comprises a first lever arm fixed in rotation on the vertical shaft, transversal to the pivoting axis and one of whose ends is connected by an articulated mechanism to a second lever arm mounted to pivot on the fixed frame around a vertical axis spaced longitudinally from the pivoting axis of the arm, ahead of the arm and one of whose ends supports a roller composing the cam follower working together with the cam-operated device, the latter determining, by displacement of the carriage, simultaneous rotation of both lever arms connected by the articulated mechanism.

This mechanism comprises, preferably, a third lever arm rotating integral with the second lever arm around the pivoting axis of the latter and one of whose ends is connected by a rod to one end of the first lever arm, whereas one of both lever arms, rotating integral together, is connected by a return spring to a point of attachment placed on the fixed frame in a position diametrically opposite to a medium position of the cam follower, on either side of which the second lever arm is actuated by the return spring towards one of both stable angular positions of the linking mechanism which determine, via the rod and the third lever arm, how to maintain the arm, respectively either in open position or in closed position, as long as the follower is not actuated by the active surface of the cam-operated device running into one direction or the other.

Particularly advantageously, in the second stable position of the articulated mechanism, the rod is placed substantially in the alignment of the third lever arm, in order to lock the mechanism by a toggle effect, in case of untimely action on the separating arm, whereas the toggle is released solely by action of the cam onto the cam follower.

Each separating arm is advantageously composed, at each intermediate level, of two semi-arms supported respectively by two supporting shafts placed on either side of the track and mounted to rotate each around a vertical axis. In such a case, the cam-operated device comprises two active surfaces placed respectively on either side of the longitudinal medium plane of the band and working together, respectively, via a cam follower device, each with an articulated rotation control mechanism of the corresponding shaft. Thus, by reverse rotation of both shafts, both semi-arms can switch from one open position, enabling the passage of the wrap-around carriage to a closed position, for which both semi-arms are substantially aligned along a direction perpendicular to the longitudinal axis.

BRIEF DESCRIPTION OF THE DRAWINGS

In the drawings, in which like reference numerals indicate corresponding arts of the preferred embodiment of the present invention throughout the several views.

DETAILED DESCRIPTION OF THE PREFERRED EMBODIMENT

As indicated, the accumulator according to the invention is of the two-way-multiportion-type comprising a wrap around carriage 1 mobile longitudinally on a track 3 and supporting several return idlers 2, on which passes the band B thereby forming several portions which run in opposite directions on several spaced levels which are determined by the mobile rollers 2 and fixed rollers, not represented, placed at the inlet of the accumulation unit, whereby regularly spaced supporting members are provided between the band portions.

Figure 1:
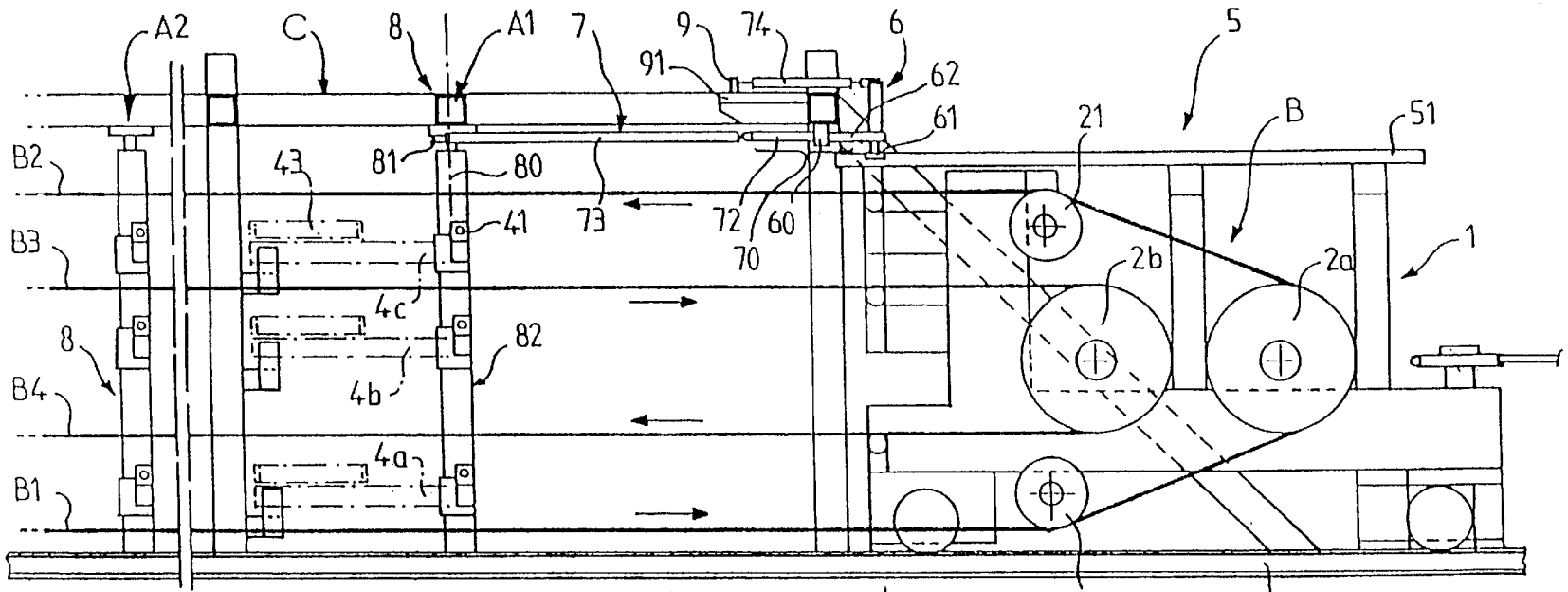
FIG. 1 represents, as a partial side view, the wrap-around carriage of n accumulator according to the invention.

FIG. 1 represents the wrap-around carriage 1 after passing a supporting member A1. The band reaches a lower level while forming a portion B1 which passes over a first return idler 2*a* in order to go backwards thus forming a portion B2. On the example represented, both portions B1 and B2 are kept away from one another, by deviating rollers 21, by a distance sufficient to enable placement of a second return idler 2*b*.

The upper portion B2 passes over a fixed return idler, not represented, placed at the inlet of the unit, i.e. on the left of the figure and turns to go forward along a portion B3 passing over the second return idler 2*b* to go backwards along the fourth portion B4, whereas the band is then sent back to another area of the factory, for example to a pickling unit.

In the example represented; the band forms therefore four portions, respectively two portions B1 and B3 that run in the out direction thereby increasing the accumulated length, i.e. from left to right on the figure and two portions B2 and B4 that run in the return direction thereby decreasing the length, i.e. from right to left.

Conventionally, in order to avoid any contacts between the portions that run in opposite directions, the unit comprises a number of intermediate supporting members, regularly spaced and arranged along the circulation path 3 of the wrap-around carriage 1.

FIG. 1 represents in detail a supporting member A1 and for exemplification purposes, another supporting member A2 placed at a certain distance form A1.

Each supporting member such as A1 comprises a set 8 of separating arms intended for being interposed transversally between two portions running in opposite directions. Consequently, in the case of a four-portion-unit B1, B2, B3, B4, the set 8 comprises three separating arms 4*a*, 4*b*, 4*c* placed at intermediate levels, respectively between the portions B1 and B4, B4 and B3, B3 and B2. These separating arms are mounted on a common shaft 82 mounted to pivot on a fixed frame C, around a vertical axis 80 and each extending horizontally to form a bracket. Each arm 4 supports, preferably, a roller 43.

Figure 3:
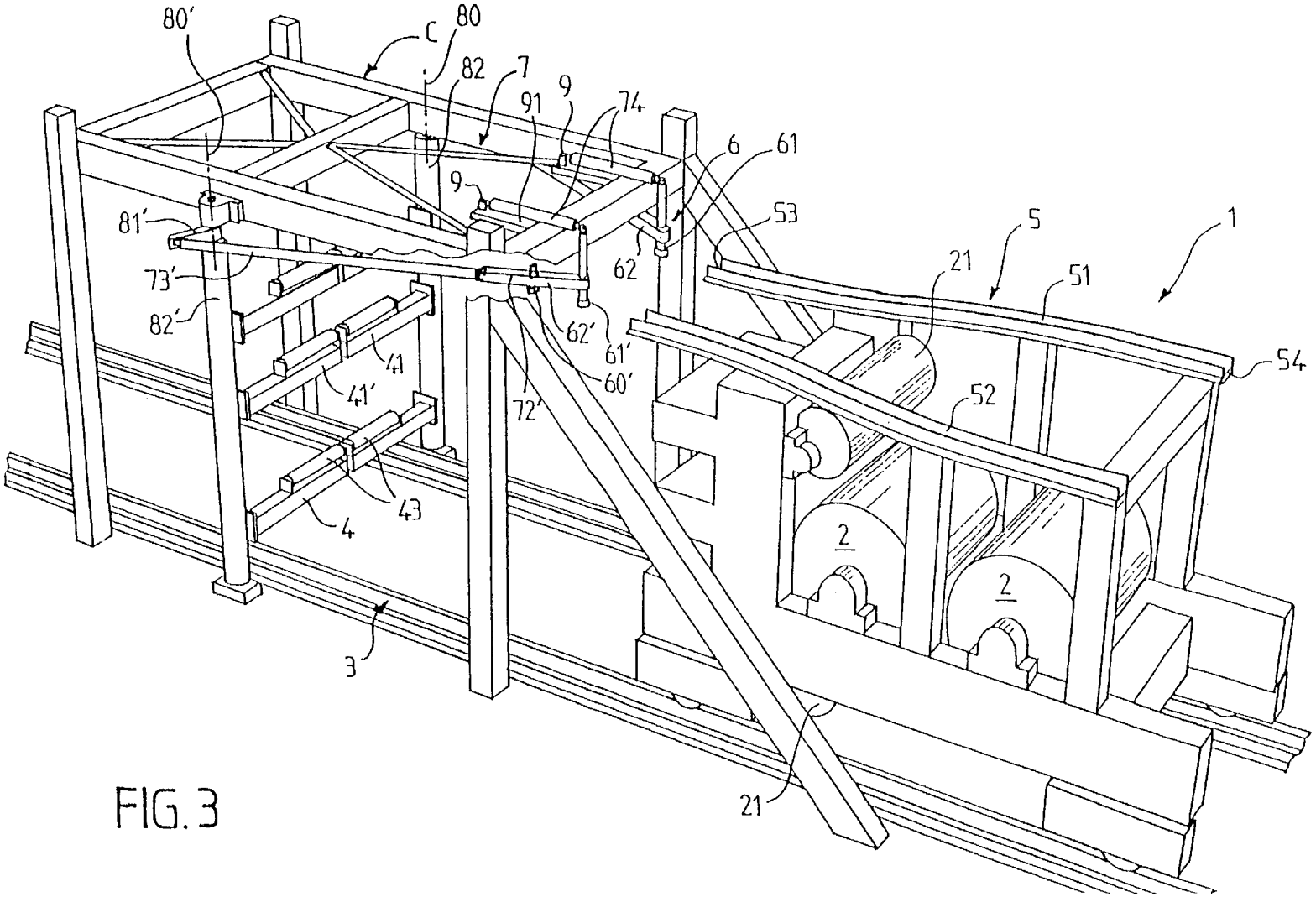
FIG. 3 shows, in perspective, a supporting member in engaged position of the arms, after passage of the wrap-around carriage.
Figure 4:
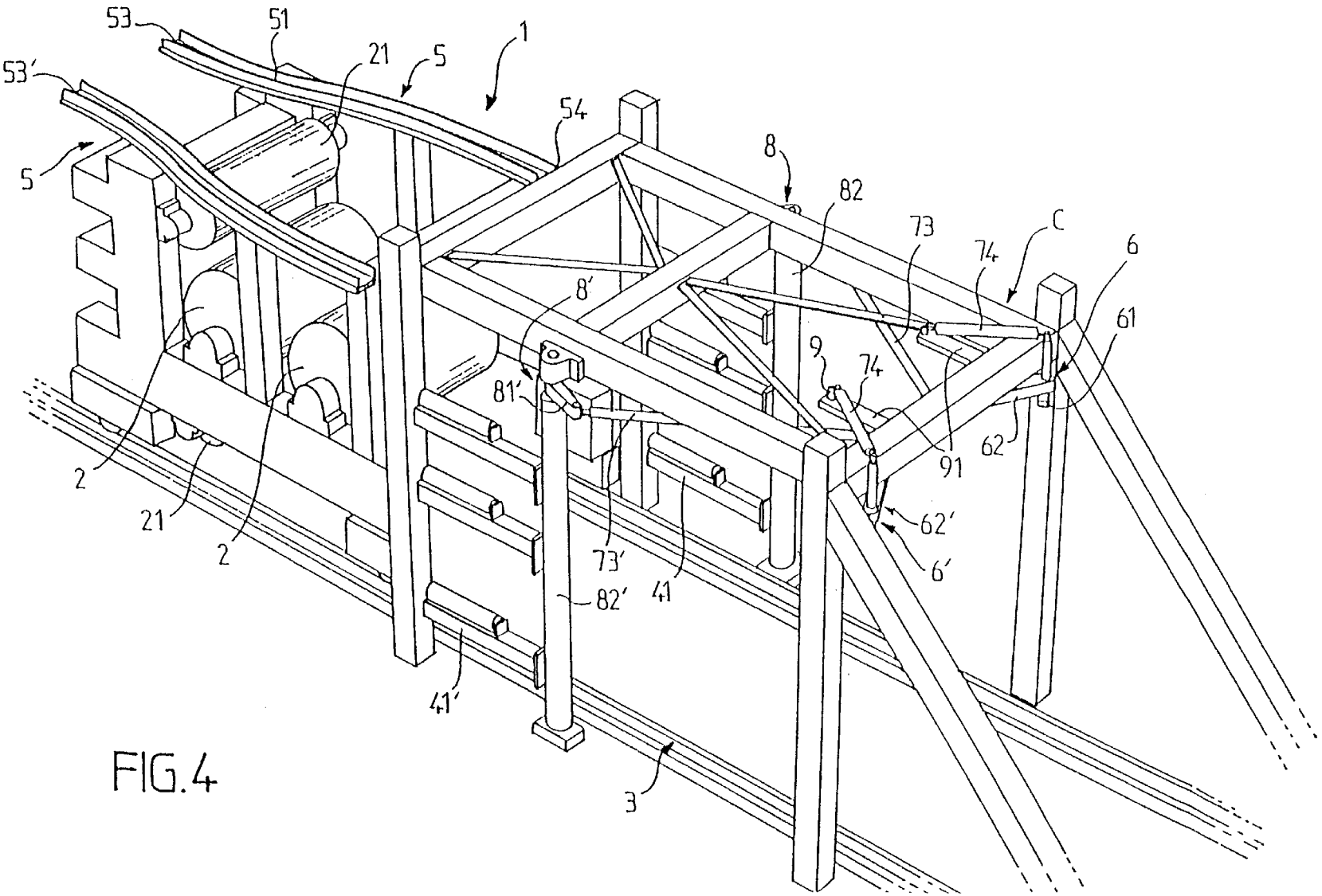
FIG. 4 shows, in perspective, a supporting member in spaced position of the arms, before passage of the wrap-around carriage.
Figure 5:
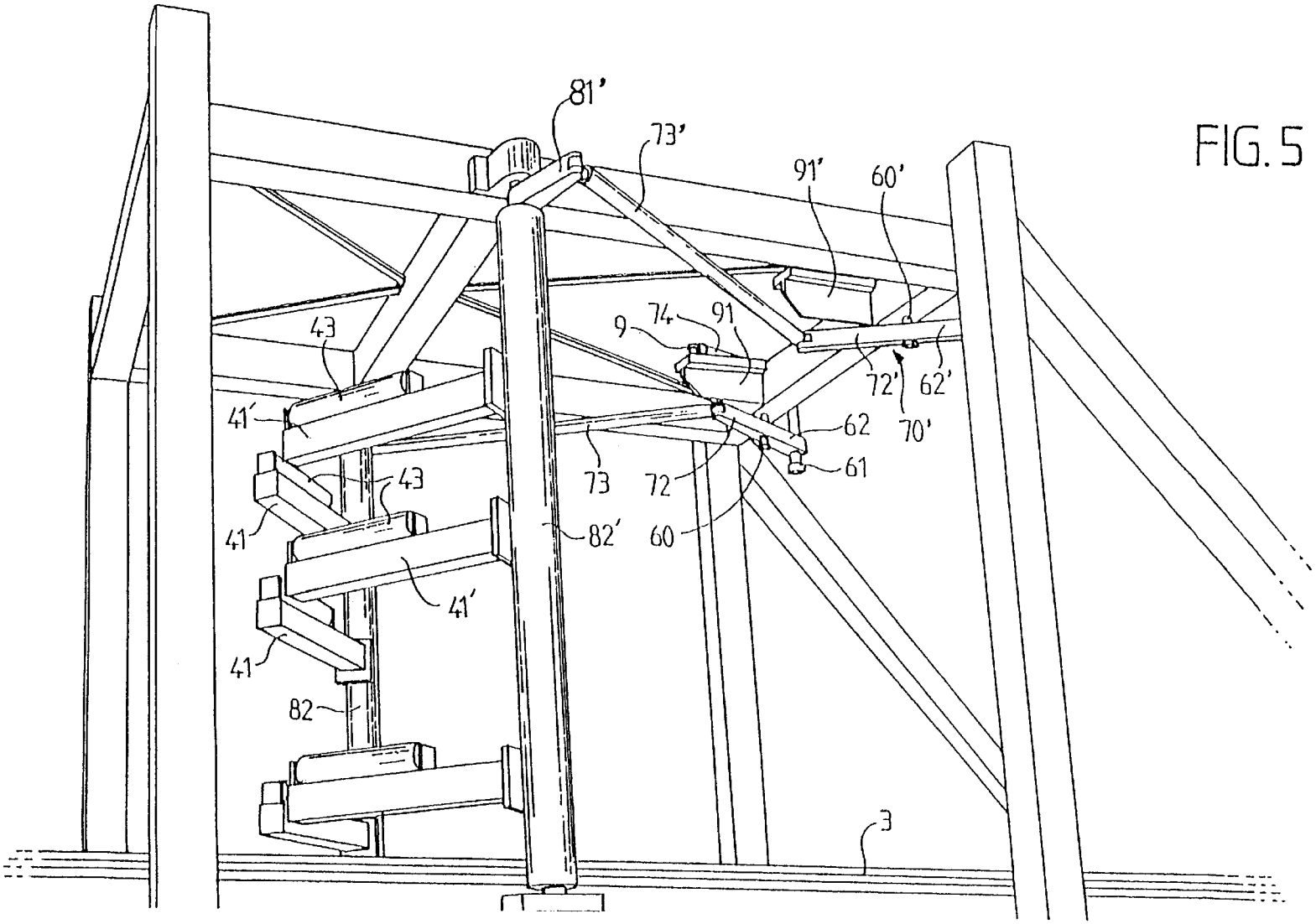
FIG. 5 shows, in perspective, a supporting member in intermediate position of the articulated mechanisms.

As shown on FIGS. 3 and 4 in perspective, and according to a conventional layout enabling to reduce the inertia of the moving masses, the supporting set 8 is composed advantageously of two parts 8, 8', each separation level comprising two semi-arms 41, 41' mounted respectively on two pivoting shafts 82, 82' placed on either side of the circulation track 3 and which therefore support, each, three semi-arms, respectively 41, 41'.

The supporting set 8 is mounted in a fixed frame C constituted of a rigid structure, of mechanically welded construction, which spans the circulation track 3 in order to provide a passage for the wrap-around carriage and the various portions of the band.

Both supporting shafts 82, 82' are mounted to pivot on the frame C, each around a vertical axis 80 and are connected to a rotation control mechanism of the arms, actuated by a follower device 6 working together with a cam-operated device 5 supported by the wrap-around carriage 1 in order to control, when the carriage 1 passes by, reverse rotation of the shafts 82, 82' supporting the separating semi-arms 41, 41', from an open position enabling the carriage to come through, for which both semi-arms 41, 41' are spread laterally, to a closed position for which both semi-arms 41, 41' are aligned at intermediate level between the portions of the band.

For example, FIG. 3 shows, in perspective, the position of both sets of arms 41, 41' after passage of the wrap-around carriage 1 that runs from left to right in the out direction for increasing the accumulated length. For simplification purposes, the various portions of the band have not been represented on the perspective figures. It can be seen that, in the closed position shown on FIG. 3, both semi-arms 41, 41' supported respectively by both shafts 82, 82' extend transversally to the running direction of the band, i.e. to the longitudinal axis of the track 3, and are substantially aligned.

When the wrap-around carriage 1 goes backwards in the return direction, i.e. towards the left-hand side of the Figure, in order to decrease the accumulated length, the arms 41, 41' must spread open, to enable the carriage to come through.

In the layout according to the document U.S. Pat. No. 3,687,348, the follower device is mounted on the side of the circulation track, at the end of a lever arm fixed to the pivoting shaft of the arm.

Thus, the follower device does not disturb the passage of the wrap-around carriage and, to anticipate the opening of the arms, the control cam is provided on a lateral frame that extends cantilever from the rear end of the wrap-around carriage. However, as indicated above, the cantilever distance is necessarily limited and the anticipation time is there rather short.

In the layout according to the invention, conversely, the follower device is independent on the arm rotation control lever and connected to the latter by an articulated mechanism whose length can be determined in relation to the anticipation period requested.

On the example represented, at each level, two semi-arms 41, 41', are used, controlled by two follower devices 6, 6' engaging respectively into two cam-operated devices 5, 5' supported by the wrap-around carriage 1 to control the opening or the closing of the semi-arms 41, 41'.

Figure 2:
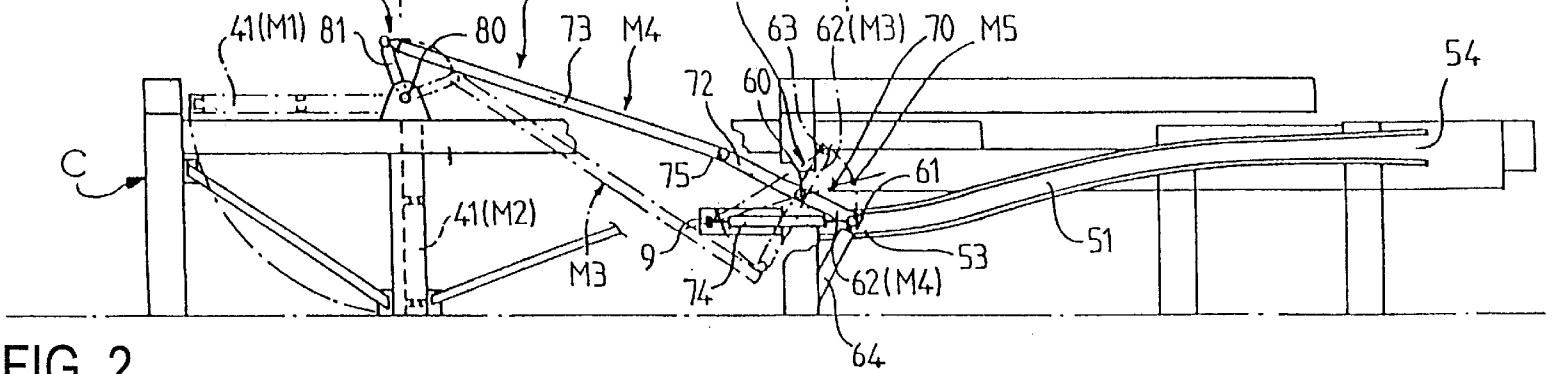
FIG. 2 is a partial view from above illustrating both stable positions of he articulated mechanism.

On FIGS. 1 and 2, it can be seen that the follower device 6 is mounted on the side of the supporting frame C and offset by a distance L ahead of the pivoting axis 80 of the separating arms 4 in the out direction of the carriage, i.e. towards the right-hand side of the figure, whereby the control lever 81 is connected to the follower device 6 via an articulated mechanism 7.

FIG. 4 shows in perspective, the position of the arms after passage of the carriage 1 from right to left in the return direction for decreasing the accumulated length. Conversely, from the position represented on FIG. 4, the wrap-around carriage 1 may go back towards the right-hand side in the out direction, in order to increase the band accumulated length, while passing between the semi-arms 41, 41' whose closing is controlled, after passage of the carriage 1, by both cam-operated devices 5, 5'.

The length of the cam 5 is of the same order of magnitude as the distance L between the follower device 6 and the corresponding pivoting control device.

Thus, in the out direction, the front section 54 of the cams 5 engages into the cam followers 61, 61' when the rear side of the carriage 1 is at the pivoting shafts 82, 82' and the cams 5, 5' control therefore the closing of the arms 41, 41' after passage of the carriage 1.

In the return direction, the arms 41, 41' are closed and the rear section 53, 53' of each cam 5, 5' engages first onto the follower 61, 61' offset ahead of the pivoting shaft 82, 82' by the distance L. The opening motion of the arms 41, 41' starts from that moment and is therefore completed when the carriage 1 reaches the axes 80, 80', whereby the followers 61, 61' then stand at the outlet 54, 54' of the cams 5, 5'.

The offset distance L can be greater than in the layout of the state of the art since it depends exclusively on the length to be given to the linking mechanism 7. Consequently, as shown on the various figures, curvature variation of the cam 5 is far more gradual and jerky progress is less likely to take place, even at very high speed, whereby the wear of the device is also reduced.

As already indicated, taking into account that the band runs at high speed, it is necessary to control the opening and the closing of the separating arms with great safety in order to prevent any deterioration. To this end, according to the invention, a particular device is used, enabling, by self-locking effect, to avoid any untimely rotation of the separating arms.

Since the various elements constituting respectively the separating arms 4, the pivoting mechanism 8, the actuating device 5, the follower device 6 and the articulated mechanism 7, are symmetrical with respect to the longitudinal axis of the wrap-around carriage 1 and of the track 3, the description below will only refer to the half section represented on FIG. 2.

In the same way, to simplify the description, the assembly composed of 25 each separating semi-arm 41 carrying a supporting roller 43 will be designated by the reference 4.

Pivoting of each separating assembly 8 is controlled by an articulated mechanism 7 actuated by the following device 6 that slides along an active surface 51 of the cam-operated device 5. The surface 51 is provided in the form of a U-section rail exhibiting approximately an S-profile, with two ends 53 and 54 placed at different distances from the longitudinal axis of the track 3 and connected by a double curvature section 52.

The active surface 51 is profiled so that the rear end 53 oriented to the fixed rollers is closer to the longitudinal axis of the carriage 1 than the front end 54 turned to the opposite side, towards the mobile rollers 2.

As indicated above, because of the rather significant offset (L) between the rotation axis 80, 80' of the arms 4 and the follower device 6, the curvature radii of the central section 52 can be sufficiently significant to ensure gradual and smooth changeover of the position of the follower 61 in relation to the longitudinal axis of the carriage 1, even when the carriage 1 moves at high speed on the track 3.

The rotation of the supporting shaft 82 of the separating arms 4 is controlled by a first lever arm 81 whose rotation is synchronous to the shaft 82, 82' and connected by the articulated mechanism 7 to the follower device 6, 6' which comprises a follower 61, 61' mounted at the end of a second lever arm 62, 62' articulated around a vertical axis 60, on the fixed frame C.

According to the invention, the first lever arm 81, 81' controlling the rotation of the separating arms 4 is connected by a rod 73, 73' articulated at its ends, to a third lever arm 72, 72' rotating integral together, around the axis 60, 60' with the second lever arm 62, 62' supporting the cam follower 61, 61'.

Normally, both lever arms 62, 62' and 72, 72' are aligned and form a single lever 70, 70' articulated on the axis 60, 60'.

The assembly thus forms an articulated mechanism 7 having two stable positions represented diagrammatically on FIG. 2, respectively a position M3 corresponding to the position M1 when the arms 4 are spread apart and a position M4 corresponding to the position M2 when the arms 4 are engaged (FIG. 2).

As indicated, when the carriage 1 moves in the return direction, i.e. from right to left on FIGS. 1 and 2, the cam follower 61 engages into the rear end 53 of the rail 51 and follows the S-profile of the rail to come out through the front end 54 which lies at a greater distance from the longitudinal axis of the track 3. The follower 61 thus controls the rotation of the lever 70, from the position M4 represented as a full line, up to the position M3 represented as a dotted line, whereby the arm 41 switching from a closed position M2 to an open position M1.

The arm 62 of the lever 70 supporting the follower 61 is connected by a return spring 74 to a fixed attachment point 9 provided on part 41 of the frame C and placed, with respect to the axis 60, in a position diametrically opposite to a medium position M5 of the arm 62. Thus, the arm 62 is maintained by the spring 74 against one of both fixed stops, respectively a stop 64 corresponding to the position M4 in which the arms are engaged and a stop 63 corresponding to the position M3 when the arms are spread apart. The possibility of stretching the spring 74 enables switching from one position to the other, but only under the action of the cam follower 61 working together with the cam 51.

Besides, according to another particularly advantageous feature, the lengths and the orientations of the different parts of the articulated mechanism 7 are determined so that, in the closing position M4, the arm 72 of the lever 70 is substantially aligned with the linking rod 73. Preferably, the stop 64 is adjustable so that the articulation 75 between the rod 73 and the lever arm 72 slightly exceeds the alignment position. The assembly forms thus a kind of toggle with self-locking effect.

Indeed, when the semi-arm 41 is in the engaged position M2 between two portions of the band, the articulated mechanism 7 is in position M4. Any undesirable action, for example a contact with the band, tends to rotate the first lever 81 integral with the shaft 82 in the opening direction of the semi-arm 41 and determines a thrust onto the rod 73 which is sustained by the arm 72 of the lever 70 whose other arm 62 is blocked, in the corresponding direction, by the stop 64. Thus, failing any action of the cam 51 on the follower 61, the mechanism, which maintains the semi-arm 41 in closed position, locks itself.

Conversely, in the spread open position M1 represented as a dotted line on FIG. 2, the articulated mechanism 7 is maintained in a stable position M3 by the spring 74 which applies the arm 62 against the stop 63. A self-locking action, however, is not necessary in the position since the arm 41 is open.

The invention therefore enables to provide certain stability of the positions M1 and M2 of the separating arms 4 while avoiding resorting to additional locking and unlocking devices.

Obviously, the invention does not limit itself to the details of the embodiment, which has just been described for exemplification purposes.

In particular, the unit has been described in the usual case where, at each level, two aligned semi-arms are used to reduce the inertia of the mobile parts, but it would of course be applicable to units using a single arm extending over the whole width of the band and controlled, then, by a single follower device 6 and a single cam 5 placed on the same side of the frame C and of the carriage 1.

Besides, the layout of the wrap-around carriage and of the different portions B1, B2, B3, B4 of the band enabling to vary the accumulated length, could be different. In the same way, the articulated mechanism 7 could be constructed otherwise. The layout represented exhibits, however, the advantage of great simplicity and may, moreover, be easily suited to existing units.

What is claimed is:

1. A band product accumulation unit comprising;

a mechanism for controlling the running of a band along a longitudinal direction;

a fixed frame;

a wrap-around carriage which is moveable on a track between a return position of minimum accumulation length and an out position of maximum accumulation length, wherein movement towards the out position increases a length while movement towards the return position decreases the length;

the band being adapted to pass over at least one return member mounted on the wrap-around carriage so as to form at least an out portion and at least a return portion and defined by at least two spaced levels;

a plurality of intermediate supporting members arranged along the track, each comprising at least one separating arm extending horizontally on at least one intermediate level disposed between two running levels of the band, each separating arm being fixed to a shaft which is pivotal about a vertical axis with respect to the fixed frame;

a mechanism for controlling the pivoting of each separating arm between an open position which allows the wrap-around carriage to move to the return position and a closed position wherein each separating arm extends transverse to and between the two running levels of the band;

a control mechanism for controlling the pivoting of each separating arm between the closed position and the open position, the control mechanism comprising;

a first lever arm coupled to the shaft and adapted to cause the shaft to rotate, the first lever arm having an end, at least one follower device, at least one active surface disposed on a cam-operated device, the cam-operated device being mounted on the wrap-around carriage, the follower device having a configuration which is offset, with respect to the pivoting axis of the at least one separating arm so as to be ahead thereof, by an offset distance corresponding to an anticipation period, a deformably articulated mechanism for controlling a closing and an opening of each separating arm, the articulated mechanism connecting the at least one follower device to the end of the first lever arm, wherein the articulated mechanism comprises two stable extreme positions, a first stable position corresponding to the open position of each separating arm and a second stable position corresponding to the closed position of each separating arm, and a removable retaining device for locking the articulated mechanism in at least the second stable position, the removable retaining device being actuated solely by the follower device which cooperates with the cam-operated device when the wrap-around carriage moves away from the out position such that the articulated mechanism is blocked towards the return position such that the articulated mechanism is released, wherein the articulated mechanism provides for a self-locking configuration in which any undesirable action is prevented such that the separating arm in the closed position until the cam-operated device activates the follower device.

2. The accumulator of claim 1, wherein the end of the first lever arm is connected to the follower device via the articulated mechanism, the follower device comprising a second lever arm which pivotally mounted to the fixed frame and pivoting about a vertical axis and a roller mounted to one end of the second lever arm, wherein the vertical axis of the second lever arm is longitudinally displaced from the vertical axis of the first lever arm, and wherein the second lever arm includes an end which supports a roller, and wherein activation of the cam-operated device with the follower device causes simultaneous corresponding movement of the first lever arm, via the articulated mechanism and the second lever arm.

3. The accumulator of claim 1, wherein one of the first and second stable positions utilizes a stop for preventing further movement of the articulated mechanism.

4. The accumulator of claim 3, wherein the stop is adjustable.

5. The accumulator of claim 1, wherein the accumulator comprises two mechanisms for controlling the pivoting of each separating arm and two control mechanisms.

6. The accumulator of claim 1, wherein the wrap-around carriage comprises at least two return idlers.

7. The accumulator of claim 6, wherein the at least two return idlers are arranged to form two running levels which run in opposite directions.

8. A band product accumulation unit comprising;

a mechanism for controlling the running of a band along a longitudinal direction;

a fixed frame;

a wrap-around carriage which is moveable on a track between a return position of minimum accumulation length and an out position of maximum accumulation length, wherein movement towards the out position increases a length while movement towards the return position decreases the length;

the band being adapted to pass over at least one return member mounted on the wrap-around carriage so as to form at least an out portion and at least a return portion and defined by at least two spaced levels;

a plurality of intermediate supporting members arranged along the track, each comprising at least one separating arm extending horizontally on at least one intermediate level disposed between two running levels of the band, each separating arm being fixed to a shaft which is pivotal about a vertical axis with respect to the fixed frame;

a mechanism for controlling the pivoting of each separating arm between an open position which allows the wrap-around carriage to move to the return position and a closed position wherein each separating arm extends transverse to and between the two running levels of the band;

a control mechanism for controlling the pivoting of each separating arm between the closed position and the open position, the control mechanism comprising;

a first lever arm coupled to the shaft and adapted to cause the shaft to rotate, the first lever arm having an end, at least one follower device, at least one active surface disposed on a cam-operated device, the cam-operated device being mounted on the wrap-around carriage, the follower device comprising a second lever arm and a roller mounted on an end of the second lever arm, the follower device having a configuration which is offset, with respect to the pivoting axis of the at least one separating arm so as to be ahead thereof, by an offset distance corresponding to an anticipation period, a deformably articulated mechanism for controlling a closing and an opening of each separating arm, the articulated mechanism connecting the at least one follower device to the end of the first lever arm, the articulated mechanism comprising two stable extreme positions, a first stable position corresponding to the open position of each separating arm and a second stable position corresponding to the closed position of each separating arm, the articulated mechanism further comprising a third lever arm which can pivot integrally with the second lever arm about the axis of the second lever arm, the third lever arm being coupled to the first lever arm via a rod, and comprising a return spring having one end coupled to the fixed frame and another end coupled to the second lever arm, the second lever arm being actuated by the return spring and cooperating with the cam-operated device, wherein the articulated mechanism provides for a self-locking configuration in which any undesirable action is prevented such that the separating arm in the closed position until the cam-operated device activates the follower device.

9. The accumulator of claim 8, wherein one of the first and second stable positions utilizes a stop for preventing further movement of the articulated mechanism.

10. The accumulator of claim 9, wherein the stop is adjustable.

11. The accumulator of claim 10, wherein each of the first and second stable positions utilizes a stop which is adjustable to produce a toggle arrangement.

12. The accumulator of claim 8, wherein the accumulator comprises two mechanisms for controlling the pivoting of each separating arm and two control mechanisms.

13. The accumulator of claim 8, wherein the wrap-around carriage comprises at least two return idlers.

14. The accumulator of claim 13, wherein the at least two return idlers are arranged to form two running levels which run in opposite directions.

* * * * *